US008272429B2

(12) United States Patent
Inatomi et al.

(10) Patent No.: US 8,272,429 B2
(45) Date of Patent: Sep. 25, 2012

(54) HEAT EXCHANGER

(75) Inventors: Takanari Inatomi, Kawasaki (JP); Shigeki Maruyama, Yokohama (JP); Yuko Kitajima, Yokohama (JP); Kenjiro Fukamichi, Sagamihara (JP); Hiroshi Nakamura, Hadano (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 925 days.

(21) Appl. No.: 12/113,521

(22) Filed: May 1, 2008

(65) Prior Publication Data

US 2008/0283230 A1 Nov. 20, 2008

(30) Foreign Application Priority Data

May 15, 2007 (JP) ..... P2007-129883

(51) Int. Cl.
*F28F 13/00* (2006.01)
*F28D 7/00* (2006.01)

(52) U.S. Cl. ..... 165/135; 165/157; 165/166; 165/176

(58) Field of Classification Search ..... 165/157, 165/158, 134.1, 136, 81, 145, 176
See application file for complete search history.

(56) References Cited

U.S. PATENT DOCUMENTS

| | | | | |
|---|---|---|---|---|
| 3,863,711 | A * | 2/1975 | Beckmann et al. | 165/145 |
| 5,771,963 | A * | 6/1998 | Blangetti et al. | 165/143 |
| 5,866,083 | A * | 1/1999 | Berglund et al. | 422/201 |
| 6,089,313 | A * | 7/2000 | Levy et al. | 165/140 |
| 2003/0173062 | A1 * | 9/2003 | Lomax et al. | 165/82 |
| 2004/0251007 | A1 * | 12/2004 | Toh et al. | 165/157 |
| 2005/0034846 | A1 * | 2/2005 | Doule et al. | 165/157 |
| 2005/0247441 | A1 * | 11/2005 | Bussonnet et al. | 165/157 |
| 2006/0254759 | A1 * | 11/2006 | Johnston | 165/167 |

FOREIGN PATENT DOCUMENTS

| | | |
|---|---|---|
| JP | 59-090092 | 5/1984 |
| JP | 61-038772 U | 3/1986 |
| JP | 05-507348 | 10/1993 |
| JP | 2005-061785 | 3/2005 |

OTHER PUBLICATIONS

"Chapter BC. Qualitative Description of Printed Circuit Heat Exchanger (PCHE) of Heatric™ Type", Workshop Oct. 2, 2003, Personal Communication, MIT Cambridge, MA, 2003,15 Pages.
Office Action issued Aug. 2, 2011 in Japanese Patent Application No. 2007-129883 filed May 15, 2007 (with Partial English Translation).

* cited by examiner

*Primary Examiner* — Frantz Jules
*Assistant Examiner* — Henry Crenshaw
(74) *Attorney, Agent, or Firm* — Oblon, Spivak, McClelland, Maier & Neustadt, L.L.P.

(57) ABSTRACT

A heat exchanger includes a vertical pressure vessel having a air-tight structure, one and another sets of fluid inlet/outlet ports provided to upper and lower portion of the vertical pressure vessel, respectively, and a heat exchanging module disposed in the pressure vessel to a portion between both sets of the fluid inlet/outlet ports, the heat exchanging module being formed by stacking a number of heat exchanging elements. At least one set of the fluid inlet/outlet ports are configured to provide a header composed of a pipe structural member having a bottom portion closed and a heat insulating material attached to an inner surface of the pipe structural member, and end portions of fluid flowing pipes communicating with the heat exchanging module are opened at the closed fluid inlet/outlet ports in the header.

3 Claims, 12 Drawing Sheets

HEAT EXCHANGER

BACKGROUND OF THE INVENTION

1. Technical Field

The present invention relates to a heat exchanger including a heat exchanging module which is configured by stacking a plurality of plates each having a groove for allowing fluid to flow, and a pressure vessel for accommodating the heat exchanging module therein.

2. Relevant Art

Conventionally, a PCHE (Printed Circuit Heat Exchanger) type heat exchanger is well known as this type of the heat exchanger as shown, for example, in the following non-patent document 1 and patent document 1.

This type of heat exchanger is configured such that a plurality of plates are stacked and grooves for allowing fluid to flow are formed to portion between the adjacent plates. Two kinds of fluids of which temperatures are different for heat exchanging are flown through the grooves such that one groove is used for flowing one fluid while the other (adjacent) groove is used for the other fluid.

In comparison with a shell-and-tube type heat exchanger or a helical coil type heat exchanger in which two kinds of liquids having temperature difference for heat exchanging are contained in grooves formed between the plates, the PCHE type heat exchanger has characteristics such that a heat exchanging performance is good and a pressure withstanding property is excellent. The structure of this conventional heat exchanger will be explained with reference to the drawings.

FIG. 11 is a cross sectional view showing the conventional heat exchanger, and FIG. 12 is a longitudinal sectional view showing the conventional heat exchanger (a sectional view taken along the line XII-XII of FIG. 11).

As shown in these FIGS. 11 and 12, the PCHE type heat exchanger 1 has a structure in which an outer partition wall 11*b* and an inner partition wall 11*a* each having a polygonal shape (for example, hexagonal shape) are provided in a pressure vessel 10, and a plurality of heat exchanging assemblies 9 (for example, six assemblies) are evenly arranged in the inner portion of the inner partition wall 11*a* in a circumferential direction thereof.

At inner and outer surfaces of the respective heat exchanging assemblies are formed with: a fluid inlet flow path 4*a* allowing one fluid for heat exchanging (hereinafter, referred to as "fluid A") to flow in a direction as indicated by an arrow A; and a fluid inlet flow path 4*b* for allowing the other fluid (hereinafter, referred to as "fluid B") to flow in a direction as indicated by an arrow B.

At upper portions of the hexagonal-shaped partition walls 11*a* and 11*b* constituting the flow paths for a fluid B outlet fluid is attached with a head portion 12 which constitutes a flow path for a fluid B inlet fluid 5*a*. A fluid A inlet pipe 8*a* and a fluid A outlet pipe 8*b* are connected to an upper portion of the head portion 12, respectively.

The heat exchanger uses a heat exchanging module 3 which is formed in a height direction by stacking a plurality of heat exchanging elements formed with the fluid A flow path and the fluid B flow path, and integrating the same by means of welding.

FIGS. 13A to 13D are explanatory views each showing assembling state of the conventional heat exchanging module, and FIGS. 14A to 14F are explanatory views each showing the conventional heat exchanging assembly.

As shown in FIGS. 13A to 13D, the heat exchanging assembly 3 is arranged in two-rows and is mounted with a partition plate 6 for partitioning a space between the fluid A inlet flow path 4*a* and the fluid A outlet flow path 4*b*, and a header 7 for partitioning the fluid A outlet flow path 4*b* from the fluid B inlet flow path 5*a*, respectively.

Then, as shown in FIGS. 14A to 14F, the header 7 is mounted to upper and lower portions of the heat exchanging assembly 3. The fluid A inlet pipe 8*a* and the fluid A outlet pipe 8*b* are connected to the head portion 12 of the upper side, respectively, thereby forming the heat exchanging assembly 9.

[Patent Document 1] Japanese Patent Application, Laid-Open, No. 2006-314864

[Non-Patent Document 1] HEATRICTUM Workshop 2 Oct. 2003, Personal Communication, MIT, Cambridge: MA, 2003

In the heat exchanger configured as described above, due to the heat exchanging operation between the fluid A and the fluid B, the temperature of the fluid B at the fluid outlet reaches to a temperature close to that of the fluid A. Accordingly, a space within the inner partition wall 11*a* and a space between the outer partition wall 11*b* and the pressure vessel 10 shown in FIGS. 11 and 12 are heated to exhibit a high temperature. Therefore, for the purpose of securing a soundness of the materials and lowering a heat loss, it is necessary to attach a heat insulating material onto surfaces of the partition walls 11*a*, 11*b* and the pressure vessel 10 to thereby lower the temperature.

On the other hand, the heat exchanging assembly 9 is also exposed to a high temperature environment by the heat of the fluid A at the fluid inlet, so that an amount of thermal expansion in a height direction of the heat exchanging assembly 9 becomes large in comparison with that of the pressure vessel 10. In this regard, in a case where the heat exchanging assembly 9 is used under a high temperature and a high pressure conditions, the heat exchanging assembly 9 is manufactured from austenite type stainless steel or nickel based alloy, while the pressure vessel 10 is generally manufactured from carbon steel or chromium-molybdenum steel from viewpoint of economy and lowering the temperature.

In this case, the austenite type stainless steel and nickel base alloy have a relatively large thermal expansion coefficient in comparison with the carbon steel or chromium-molybdenum steel, so that a difference in thermal expansion between the heat exchanging assembly 9 and the pressure vessel 10 becomes greatly large. Therefore, in a case where the outlet/inlet pipes 8*a*, 8*b* of the fluid A connected to the upper portion of the heat exchanging assembly 9 are drawn out from the upper portion of the pressure vessel 10 to an outside of the pressure vessel 10, it is necessary to equip and install an expansion joint, for example, bellows type expansion joint for the purpose of absorbing the thermal expansion.

In case of providing this expansion joint, an inverse differential pressure is applied to the expansion joint at the time of loss of fluid A accident. When the differential pressure is large, there may be an extremely high risk of the expansion joint being ruptured, and a fatal damage would occur at a boundary between the fluid A and the fluid B.

Further, in a case where the expansion joint is used under a creep temperature range, an amount of expansion and contraction per one absorbing unit of the expansion joint is limited to an extremely small value so as to prevent a creep fatigue rupture, so that it is required to attach a massive amount of the expansion joints to the pipes. Therefore, a scale and size of the heat exchanger is disadvantageously increased due to installation of the massive joints.

Furthermore, as shown in FIGS. 11 and 12, not only the inner and outer partition walls 11*a*, 11*b*, but also supporting plates 13 for supporting the head portion 12 and the heat exchanging assembly 9 are connected to the heat exchanging assembly 9. In general, the heat exchanging assembly 9 is exposed to corrosive fluid and high temperature environment, and is subject to erosion or corrosion by fluids and high-temperature corrosion. Therefore, at a time of periodical inspection or occurrence of damage, a repairing or replacement of members are required. However, since various structural members are combined and connected to the heat exchanging assembly 9 as a main equipment, it is extremely difficult to perform maintenance and replacing operation.

SUMMARY OF THE INVENTION

The present invention was conceived in consideration of the circumstances mentioned above and an object of the present invention is to provide a heat exchanger having a compact size and pressure withstanding property and being excellent in maintenance/repairing property and reliability.

This and other objects can be achieved according to the present invention by providing a heat exchanger including:

a vertical pressure vessel having a air-tight structure;

one set of fluid inlet/outlet ports provided to an upper portion of the pressure vessel;

another set of fluid inlet/outlet ports provided to a lower portion of the pressure vessel; and a heat exchanging module disposed in the pressure vessel to a portion between both sets of the fluid inlet/outlet ports, the heat exchanging module being formed by stacking a number of heat exchanging elements, wherein at least one set of the fluid inlet/outlet ports are configured to provide a header composed of a pipe structural member having a bottom portion closed and a heat insulating material attached to an inner surface of the pipe structural member, and end portions of fluid flowing pipes communicating with the heat exchanging module are opened at the closed fluid inlet/outlet ports in the header.

In a preferred embodiment of the above aspect, the pressure vessel may be provided with a supporting pedestal, by which the heat exchanging module is supported.

It may be desired that the one fluid inlet port and the another fluid outlet port are closely arranged to each other in the pressure vessel.

A connecting portion of one fluid outlet plenum and the other fluid outlet pipe of the heat exchanging module may be provided to a portion closest to a side of the fluid flowing pipe.

The pressure vessel may be provided with a manhole.

According to the present invention of the characters mentioned above, it is possible to provide a heat exchanger having a small size and pressure withstanding property and being excellent in maintenance/repairing property and reliability.

The nature and further characteristic features of the present invention will be made clearer from the following descriptions made with reference to the accompanying drawings.

DESCRIPTION OF THE PREFERRED EMBODIMENTS

Figure 1:
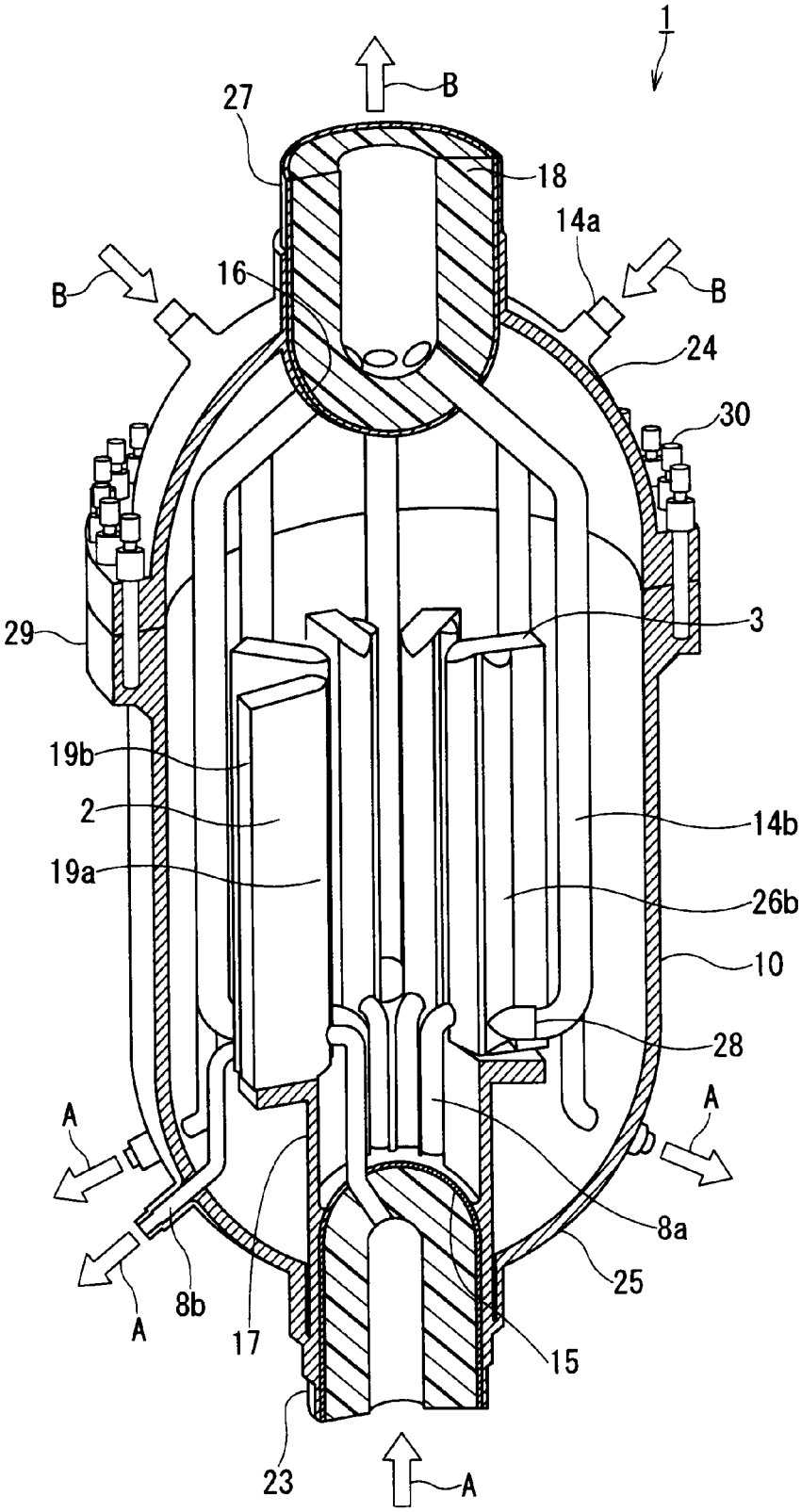
FIG. 1 is an overall perspective view, partially in section, of a first embodiment of a heat exchanger according to the present invention.

Embodiments of the heat exchanger according to the present invention will be described hereunder with reference to the accompanying drawings of FIG. 1 to FIG. 10. It is further to be noted that the same reference numerals are used to denote the same elements or members as those of the conventional heat exchanger explained in connection with FIG. 11 to FIG. 14, and that terms "upper", "lower", "right", "left" and the like terms are used herein with reference to the illustration of the drawings or in a usual standing state of the heat exchanger.

First Embodiment

FIG. 1 to FIG. 8

Figure 2:
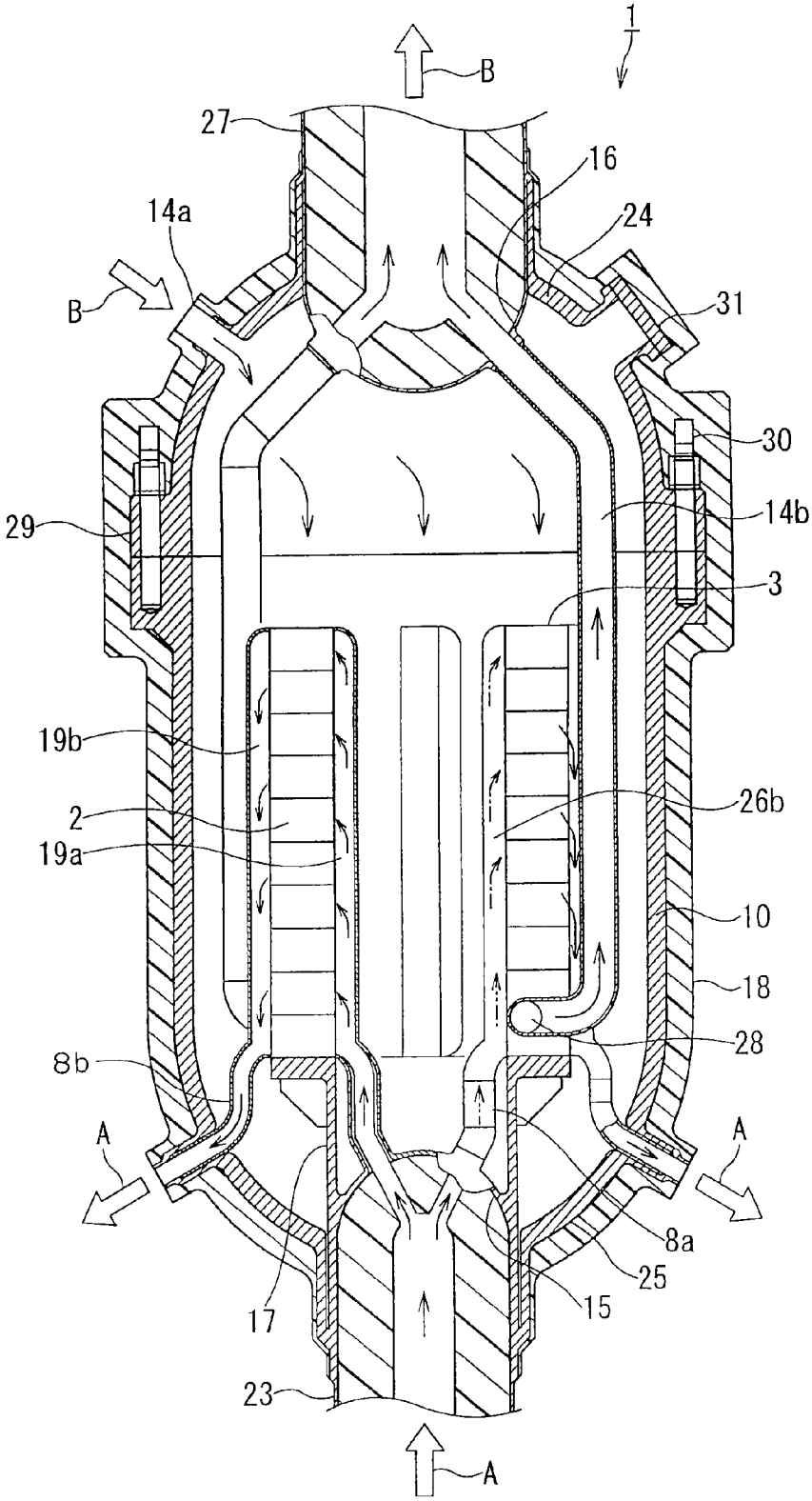
FIG. 2 is a longitudinal sectional view schematically showing a structure of a heat exchanger shown in FIG. 1.
Figure 3:
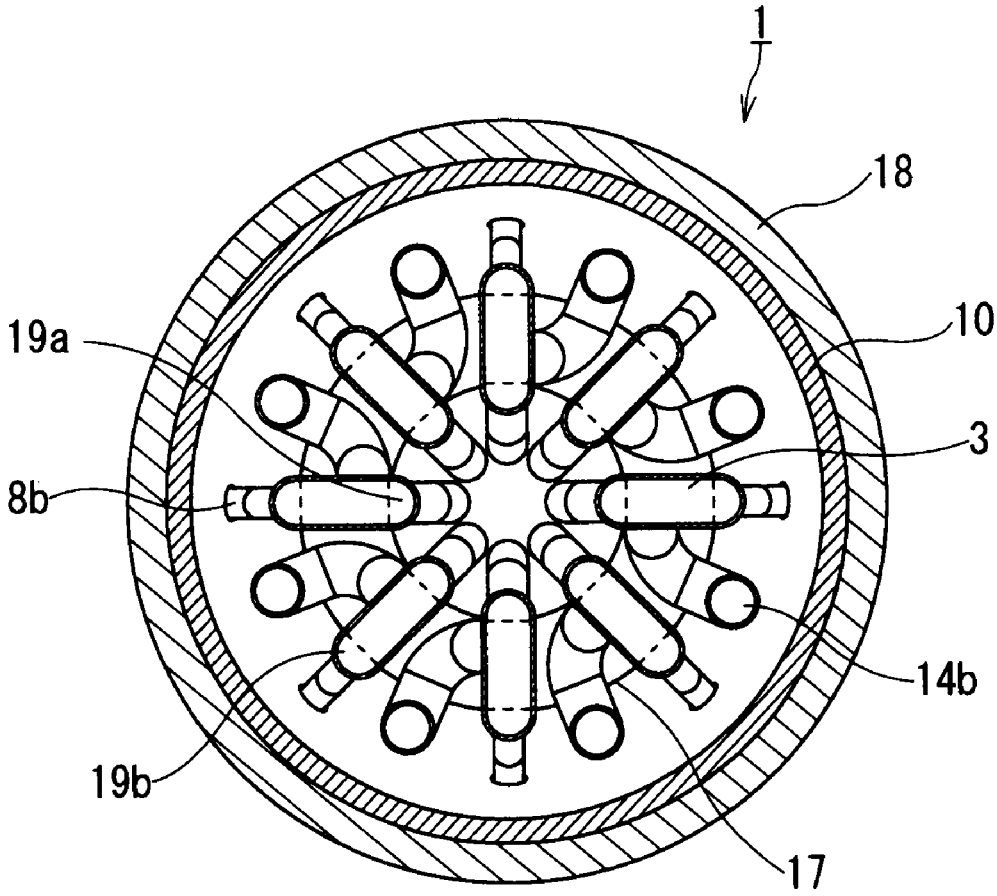
FIG. 3 is a cross sectional view schematically showing the structure of the heat exchanger shown in FIG. 1.

As shown in FIG. 1 to FIG. 3, a heat exchanger 1 according to the present embodiment comprises a pressure vessel 10 having an air tight structure. The pressure vessel 10 has, for example, a spindle-shape (i.e., fusiform-shape) in outer appearance which extends in a vertical direction. Shell portion of the pressure vessel 10 has a two-block structure in which the shell portion is divided into two portions, i.e. an upper shell portion and a lower shell portion. The upper and lower shell portions are combined in a vertical direction by means of flange portions 29, and the flange portions 29 are integrally fixed by means of a plurality of stud bolts 30.

In addition, an upper side bent portion (upper end cover) 24 of the pressure vessel 10 is provided with a plurality of fluid B inlet nozzles 14*a* so as to surround an axial center extending in a vertical direction, so that the fluid B as a heat receiving fluid is allowed to flow into the pressure vessel 10 through the fluid B inlet nozzle 14*a*. Further, an upper central portion of the pressure vessel 10 is provided with an outlet pipe 27 for discharging the fluid B to outside.

This outlet pipe 27 is a pipe having a closed structure (blocked structure) in which a bottom portion of the pipe extending into the pressure vessel 10 has a U-shape in section. Since this pipe is inserted into the pressure vessel 10 at a predetermined depth, the pipe is configured as a fluid B header (outlet header) 16 for discharging the fluid B. A heat insulating material 18 having a large thickness is attached to an inner peripheral portion and a closed portion of the fluid B header 16.

Further, a central portion of a lower side bent portion (lower end cover) 25 of the pressure vessel 10 is provided with an inlet pipe 23 for accepting the fluid A having a high temperature for heat exchanging function. This inlet pipe 23 is also a pipe having the closed structure (blocked structure) in which an upper portion of the pipe extending into the pressure vessel 10 has a U-shape in section. Since this pipe is inserted into the pressure vessel 10 at a predetermined depth, the pipe is configured as a fluid A header (inlet header) 15 for introducing the fluid A. The heat insulating material 18 having a large thickness is also attached to an inner peripheral portion and a closed portion of the fluid A header 15.

Further, a lower side bent portion (lower end cover) 25 of the pressure vessel 10 is provided with a plurality of fluid A outlet pipe 8*b* so as to surround an axial center extending in a vertical direction, so that the fluid A which is a fluid for heat exchanging is discharged from the pressure vessel 10 through the fluid A outlet pipe 8*b*.

Heat exchanging modules 3 each composed of a plurality of heat exchanging elements 2 are arranged in the pressure vessel 10. These heat exchanging modules 3 are supported by a supporting pedestal 17 which is provided so as to upwardly protrude from the fluid A header 15. The heat exchanging module 3 is formed with a plurality of fluid A inlet plenums 19*a* and fluid B outlet plenums 19*b*. A fluid A inlet pipe 8*a* and a fluid A outlet pipe 8*b* are connected to these fluid A inlet plenum 19*a*. In addition, a fluid B outlet pipe 14*b* is connected to a fluid B outlet plenum 19*b*.

As explained above, the heat exchanger 1 according to the present embodiment is configured by mainly comprising: the heat exchanging module 3; the fluid A inlet pipe 8*a*; the fluid A outlet pipe 8*b*; the fluid B inlet nozzle 14*a*; the fluid B outlet pipe 14*b*; the fluid A header 15; the fluid B header 16; the pressure vessel 10; the supporting pedestal 17; and the heat insulating material 18.

In this regard, constitutional elements of the heat exchanging module 3 will be explained hereunder with reference to FIG. 4 to FIG. 8.

Figure 4A:
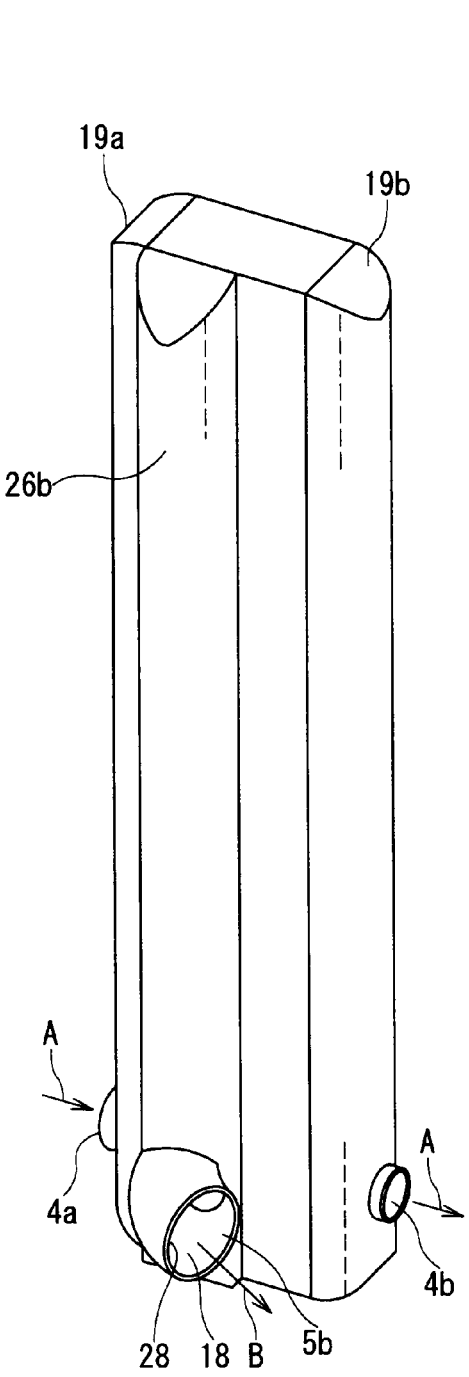
FIG. 4A is an enlarged perspective view showing a heat exchanging module of the heat exchanger shown in FIG. 1.
Figure 4B:
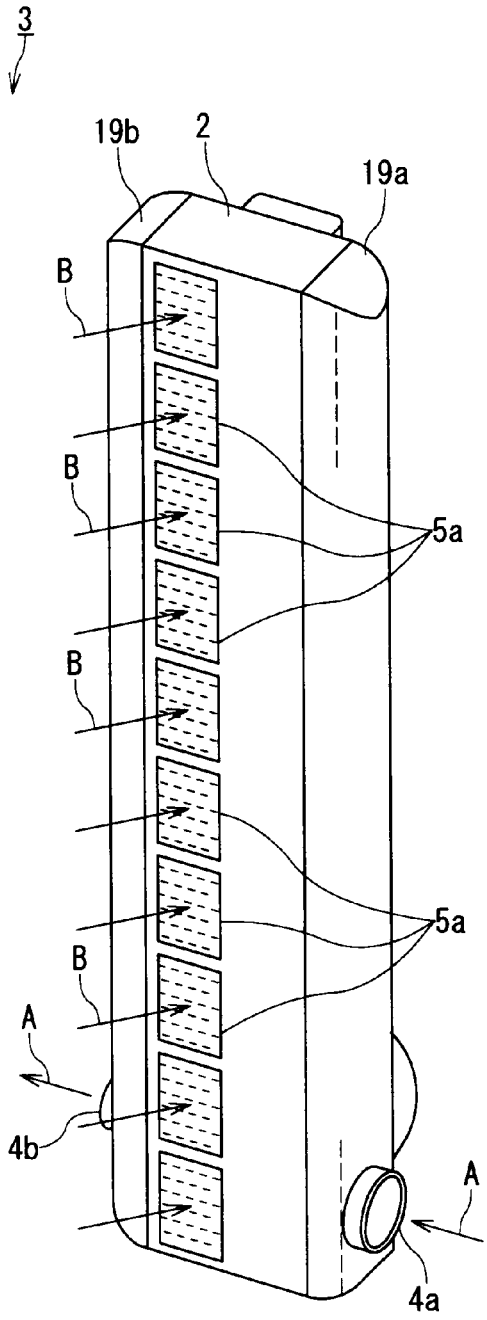
FIG. 4B is a rear-side view of the heat exchanging module shown in FIG. 4A.

FIG. 4A is an enlarged perspective view showing the heat exchanging module 3 of the heat exchanger 1 shown in FIG. 1, and FIG. 4B is a rear-side view of the heat exchanging module shown in FIG. 4A.

As shown in FIG. 4A and FIG. 4B, the heat exchanging module 3 is prepared by stacking a number of heat exchanging elements 2 to form a stacked body, followed by integrally bonding the stacked body by means of welding or the like.

The heat exchanging module 3 is formed with the fluid A inlet plenum 19*a* and the fluid B outlet plenums 26*b* which constitute collecting portions for collecting the fluid A or the fluid B. A lower end portion of the fluid B outlet plenums 26*b* is provided with a connecting portion 28 for connecting the pipes, and a front end portion of the connecting portion 28 is provided with a fluid B outlet flow path 5*b*. A heat insulating material 18 is attached to an inner surface of the fluid B outlet flow path 5*b*.

A fluid A inlet flow path 4*a* and a fluid A outlet flow path 4*b* are arranged on a surface of the stacked body composed of a number of heat exchanging elements 2. The fluid B outlet plenums 26*b* and the fluid A inlet plenum 19*a* are provided with fluid B inlet flow paths 5*a*.

Figure 5A:
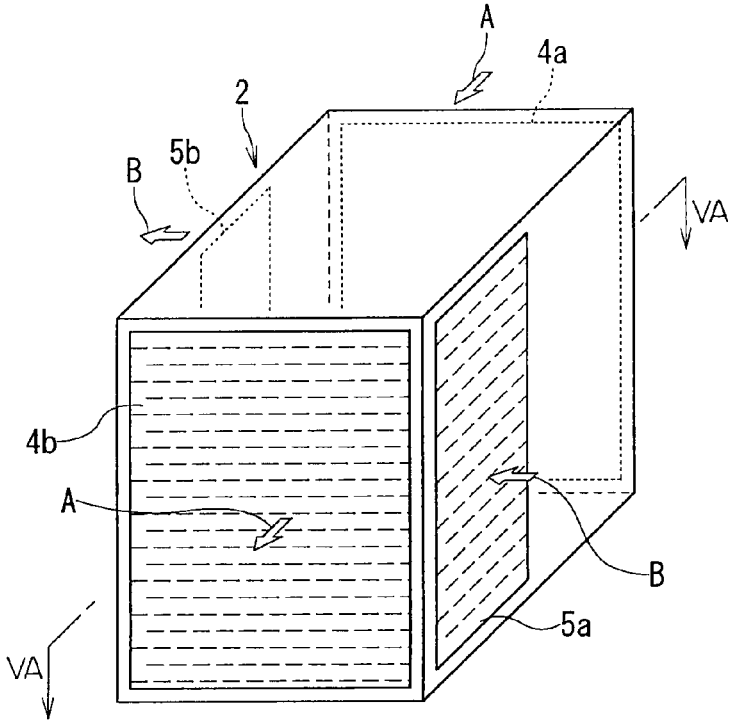
FIG. 5A is a perspective view showing a heat exchanging element constituting the heat exchanging module shown in FIG. 4.
Figure 5B:
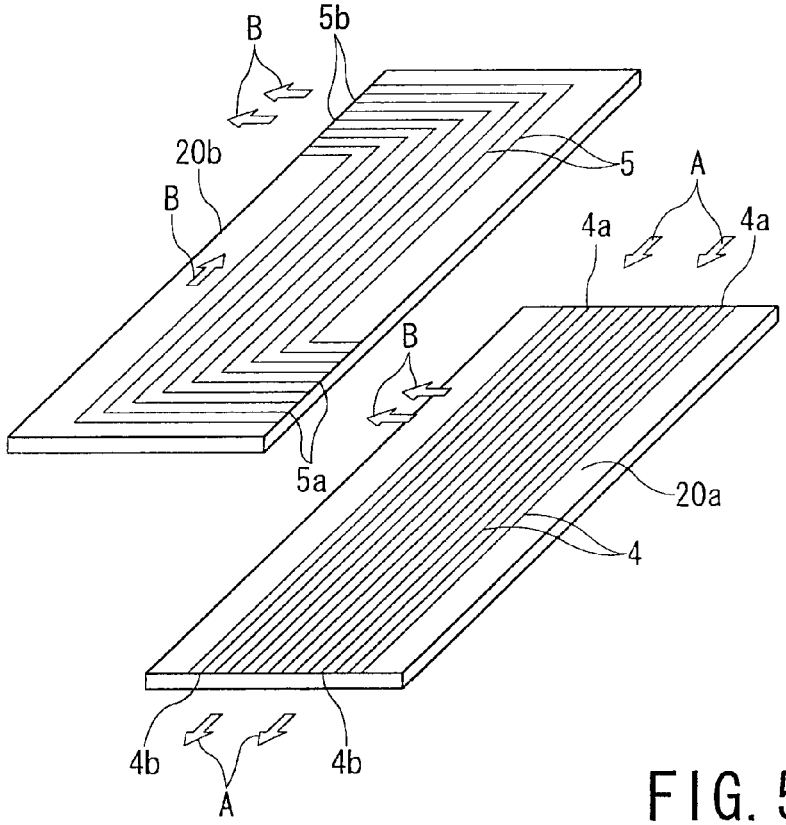
FIG. 5B is an exploded view (sectional view taken along the line VA-VA in FIG. 5A) showing the heat exchanging element shown in FIG. 5A.

Further, FIG. 5A is a perspective view showing each of heat exchanging elements constituting the heat exchanging module shown in FIG. 4, and FIG. 5B is an exploded view of the heat exchanging element shown in FIG. 5A. As shown in these figures, the heat exchanging element 2 is configured by stacking a fluid A side metal plate 20*a* and a fluid B side metal plate 20*b*. These fluid A side metal plate 20*a* and a fluid B side metal plate 20*b* are formed with a number of fluid A inlet flow paths 4*a* and fluid A outlet flow paths 4*b* serving as fluid A flow path 4.

Furthermore, a number of fluid B inlet flow paths 5*a* and fluid B outlet flow paths 5*b* are formed as fluid A flow path 4. In these flow paths 5*a* and 5*b*, the fluid A and the fluid B would flow in the opposing directions.

Figure 6:
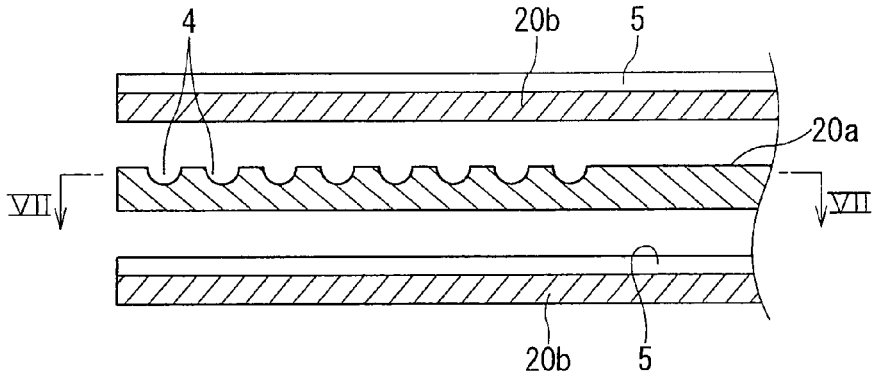
FIG. 6 is an enlarged sectional view showing the heat exchanging element shown in FIG. 5B.
Figure 7:
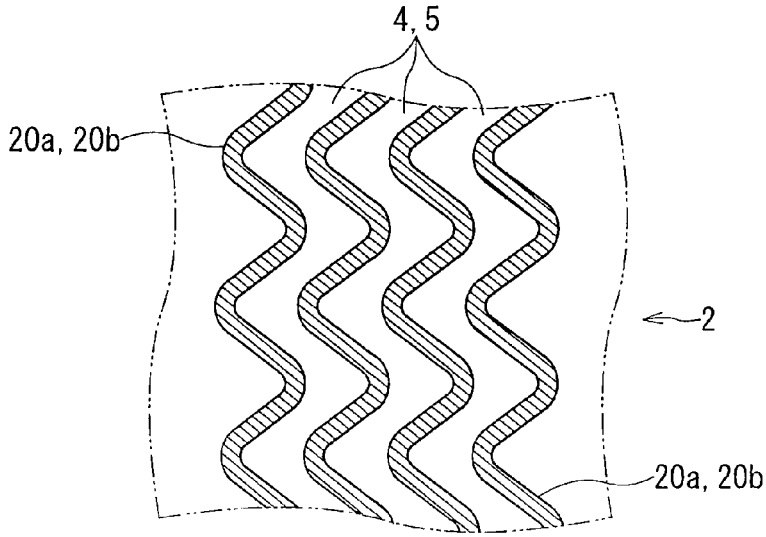
FIG. 7 is a sectional view taken along the line VII-VII of FIG. 6.
Figure 8:
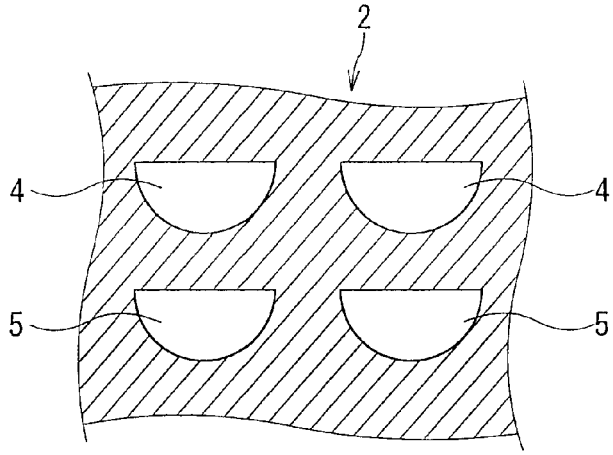
FIG. 8 is an enlarged cross sectional view schematically showing a connected-state of the heat exchanging element shown in FIG. 6.

FIG. 6 is an enlarged sectional view showing the heat exchanging element shown in FIG. 5B, FIG. 7 is a sectional view taken along the line VII-VII of FIG. 6, and FIG. 8 is an enlarged cross sectional view schematically showing a connected-state of the heat exchanging element shown in FIG. 6.

As shown in these figures, the fluid A side metal plate 20*a* and the fluid B side metal plate 20*b* are formed with the heat exchanging element 2, fluid A flow paths 4 and fluid B flow paths 5 as zigzag flow paths, respectively. Although the flow paths, each having a semi-circular shape in section, are adopted in the present embodiment, the other flow paths having various shapes in section may be also adopted.

The structure and function of the present embodiment composed of the above constitutional elements will be explained again hereunder with reference to FIG. 1 to FIG. 4.

As shown in FIG. 4, the heat exchanging module 3 is prepared by stacking a plurality of the heat exchanging elements 2, followed by integrally fixed, for example, by means of welding. The fluid A inlet plenum 19*a* and fluid B outlet plenums 19*b* constituting the collecting portions for collecting the fluid A or the fluid B are attached to the heat exchanging module 3.

As shown in FIG. 5, the heat exchanging element 2 is prepared by alternately stacking and bonding the metal plate 20*a* and the metal plate 20*b* that are subjected to a groove forming work. The groove is used as a flow path for flowing the fluid A or the fluid B. Namely, the fluid A flow paths 4 and the fluid B flow paths 5, each having a groove-shape for the heat exchanging operation, are formed to a portion between the two metal plates 20*a* and 20*b*. This heat exchanging element 2 is further stacked and integrally bonded, and the fluid A inlet plenum 19*a* and fluid B outlet plenums 19*b* formed with the collecting portions for collecting the fluid A or the fluid B are attached to the stacked body to thereby prepare the heat exchanging module 3. This structure of the heat exchanging module 3 is shown in FIG. 4.

The heat exchanging module 3 is mounted on a supporting pedestal 17 which is integrally combined with the fluid A header 15. The fluid A inlet pipe 23 of the fluid A header 15 is closed and blocked, while a heat insulating material 18 is attached to an inner portion of the fluid A header 15. The fluid A header 15 per se is supported by the pressure vessel 10. In a case where the heat exchanging module 3 has a small size, the supporting pedestal 17 may not be required, and the heat exchanging module 3 will be supported by the fluid A inlet pipe 8*a*. However, in a case where the heat exchanging module 3 has a large size as shown in FIG. 1, it is required to provide the supporting pedestal 17 for supporting a heavy weight.

In this case, when the fluid A header 15 and the supporting pedestal 17 are integrally combined, a lower space of the pressure vessel 10 can be simplified. In addition, a welding operation for combining the supporting pedestal 17 to the pressure vessel 10 can be eliminated, thus resulting in improvement of the reliability of the boundary.

The fluid A inlet pipe 8*a* drawn out from the fluid A header 15 is connected to the fluid A inlet plenum 19*a* of the heat exchanging module 3, and the heat insulating material 18 is attached to an inner portion of the fluid A header 15. Due to function of this heat insulating material 18, a temperature of the fluid at the fluid A inlet pipe 8*a* can be lowered to a temperature extremely close to a temperature of the fluid B which flows into the pressure vessel 10 from the fluid B inlet nozzle 14*a* provided to the upper cover plate 24 of the pressure vessel 10.

On the other hand, the fluid A outlet pipe 8*b* is a pipe for connecting the fluid B outlet plenums 19*b* of the heat exchanging module 3 to the lower cover plate 25 of the pressure vessel 10. The fluid A outlet fluid flowing in this pipe has a temperature close to that of the fluid B inlet fluid, and it is therefore not necessary to attach the heat insulating material 18.

Further, the heat insulating material 18 is also attached to an outer circumferential portion of the pressure vessel 10 as shown in FIG. 2 for a countermeasure for minimizing a heat loss caused by heat transmission from inside of the heat exchanger 1 to outside. Therefore, a wall temperature of the pressure vessel 10 is substantially the same as that of fluid B inlet fluid contained in the pressure vessel 10.

In this connection, as a material for constituting the pressure vessel 10 and pipes, it is preferable to adopt chromium-molybdenum steel or low alloy steel in view of a relatively low temperature of the fluid B inlet fluid. Further, in a case where the fluid B is a corrosive fluid, an austenitic stainless steel may be suitably applied. Furthermore, it is preferable that the pressure vessel 10 and the pipes are formed by using the same material.

In the present embodiment as described above, structural elements or members such as the fluid A inlet pipe 8*a*, the fluid A outlet pipe 8*b* and the supporting pedestal 17 are closely arranged in the pressure vessel 10, so that the temperature of the structural members becomes almost the same level, whereby a difference in thermal expansion between the respective structural members can be lowered to an extremely small level.

Accordingly, it becomes unnecessary to attach the expansion joints to the fluid A inlet pipe 8*a*, and hence, the risk of the boundary damage caused at the pressure loss accident of the fluid A side pipes can be effectively lowered. Further, the temperature of the pressure vessel 10 can be lowered, so that a thickness of the pressure vessel 10 can be made thin, thereby lowering a production cost of the heat exchanger.

Furthermore, as shown in FIG. 4 and FIG. 5, the fluid B passes through the fluid B inlet flow path 5*a* provided to a side surface of the heat exchanging module 3, and then flows into the heat exchanging module 3 at which the fluid B is heat-exchanged with the fluid A in a countercurrent manner. Then, the fluid B passes through the fluid B outlet flow paths 5*b* and flows out to the fluid B outlet plenum 26*b*. Thereafter, the fluid B passes through the fluid B outlet pipe 14*b*, which has an inner portion attached with the heat insulating material 18.

Subsequently, the fluid B is drawn out from the fluid B outlet plenum 26*b* and led to the fluid B header 16. The fluid B header 16 is connected to the upper cover plate 24 and has a blocked-structure in which a lower end portion of the fluid B outlet pipe 27 is blocked and closed. An inner surface of the blocked portion is provided with the heat insulating material 18.

In this connection, the fluid B can be also directly led to outside the pressure vessel 10 without passing through the fluid B header 16. However, in case of providing the fluid B header 16, the number of through holes penetrating the pressure vessel 10 can be decreased, resulting in the improvement in the reliability of the boundary. In addition, there is no need to provide the header to an outside of the pressure vessel 10, so that it becomes possible to save a space for installing the heat exchanger and to lower the cost of manufacturing equipments required for the heat exchanger.

Furthermore, according to the present embodiment, the connecting portion 28 for connecting the fluid B outlet pipe 14*b* to the fluid B outlet plenum 26*b* is formed to a side, which is the closest side to the fluid A pipes 8*a* and 8*b*. Due to this structure, the difference in thermal expansion between the heat exchanging module 3 and the fluid B outlet pipe 14*b* can be minimized, so that it becomes unnecessary to attach the expansion joints to the fluid B outlet pipe 14*b*. Therefore, a height of the pressure vessel 10 can be shortened at amount of height corresponding to a space required for installing the expansion joints.

Furthermore, as shown in FIG. 2 and FIG. 3, according to the present embodiment, the upper cover plate 24 is provided with a manhole 31. Due to this structure, a worker can easily enter into the pressure vessel 10 or the equipments can be easily inserted into the pressure vessel 10 through the manhole 31. Accordingly, it becomes possible to perform a simple maintenance and a repairing operation.

In a case where a large-scaled engineering work is required, the pressure vessel 10 is opened and dismantled at the flange portion 29. Under this opened state, it is possible to repair or replace the heat exchanging module 3 or the various pipes. The heat exchanging module 3 or the various pipes may be also fixed in the pressure vessel 10 by a bolt-screw fastening. In such a case, a replacement of an old equipment with new one can be easily performed even in the midstream of a life span of the heat exchanger.

As a result, according to the present first embodiment, there can be provided a heat exchanger having a small size and pressure withstanding property, and being excellent in maintenance/repairing property and reliability.

Second Embodiment

FIG. 9

Figure 9:
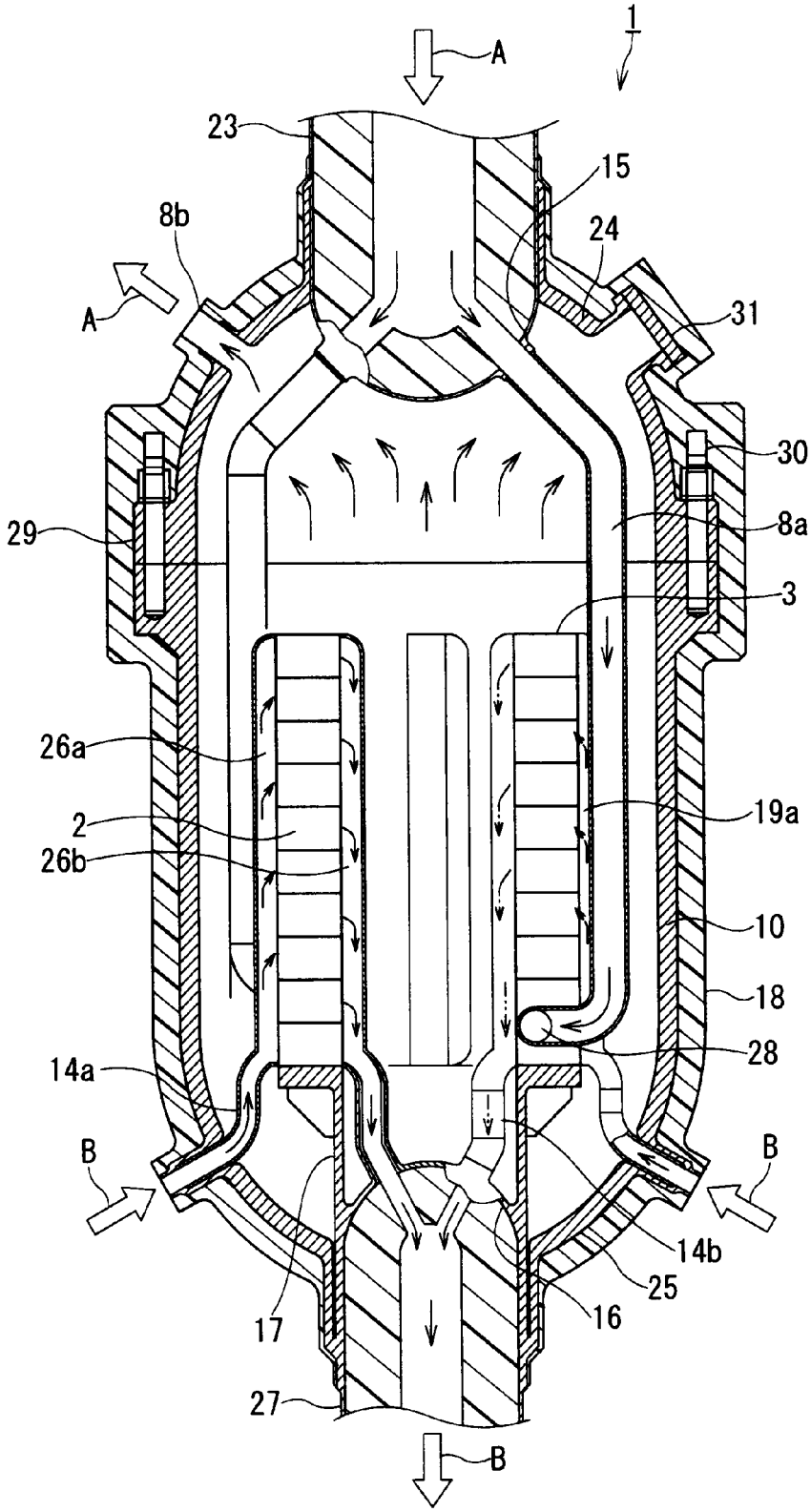
FIG. 9 is a longitudinal sectional view schematically showing a structure of a second embodiment of a heat exchanger according to the present invention.

FIG. 9 is a longitudinal sectional view schematically showing a structure of a second embodiment of a heat exchanger according to the present invention. In this regard, the same reference numerals are used in FIG. 9 to denote the same elements or members as those of the first embodiment explained in connection with FIG. 1 to FIG. 8.

As shown in FIG. 9, the heat exchanger 1 of the second embodiment has a structure in which the fluid A and the fluid B flow in the directions opposite to those in the first embodiment. That is, the heat exchanger 1 of the present second embodiment also includes a pressure vessel 10 having an air tight structure. The pressure vessel 10 has, for example, a spindle-shape in outer appearance which extends in a vertical direction. The shell portion of the pressure vessel 10 has a two-block structure to be dividable into two portions, i.e. an upper shell portion and a lower shell portion. The upper and lower shell portions are combined in a vertical direction through flange portions 29, and the flange portions 29 are integrally fixed by means of a plurality of stud bolts 30.

Specifically, in the present second embodiment, the outlet/inlet structural portions of the fluid A and the fluid B shown in FIGS. 1 and 2 of the first embodiment are turned upside down.

Namely, the fluid B outlet pipe 27 shown in FIGS. 1 and 2 is substituted for the fluid A inlet pipe 23, the fluid B inlet pipe 14*a* is substituted for the fluid A outlet nozzle 8*b*, the fluid A header 15 is substituted for the fluid B header 16, the fluid B outlet pipe 14*b* is substituted for the fluid A inlet pipe 8*a*, and the fluid A inlet plenum 19*a* is substituted for the fluid B inlet plenum 26*a*, respectively. Due to this structure, the fluid A is supplied from an upper portion of the pressure vessel 10, while the fluid B is discharged from a lower portion thereof. The other structural elements or members are substantially the same as those of the first embodiment.

When adopting this structure, even if the fluid A and the fluid B are supplied in the reverse directions in some plants, the heat exchanger 1 can cope with such matter, and the same effects can be obtained. Further, according to the present embodiment, there can be also provided a heat exchanger having a small size and pressure withstanding property, and being excellent in maintenance/repairing property and reliability.

Third Embodiment

FIG. 10

Figure 10:
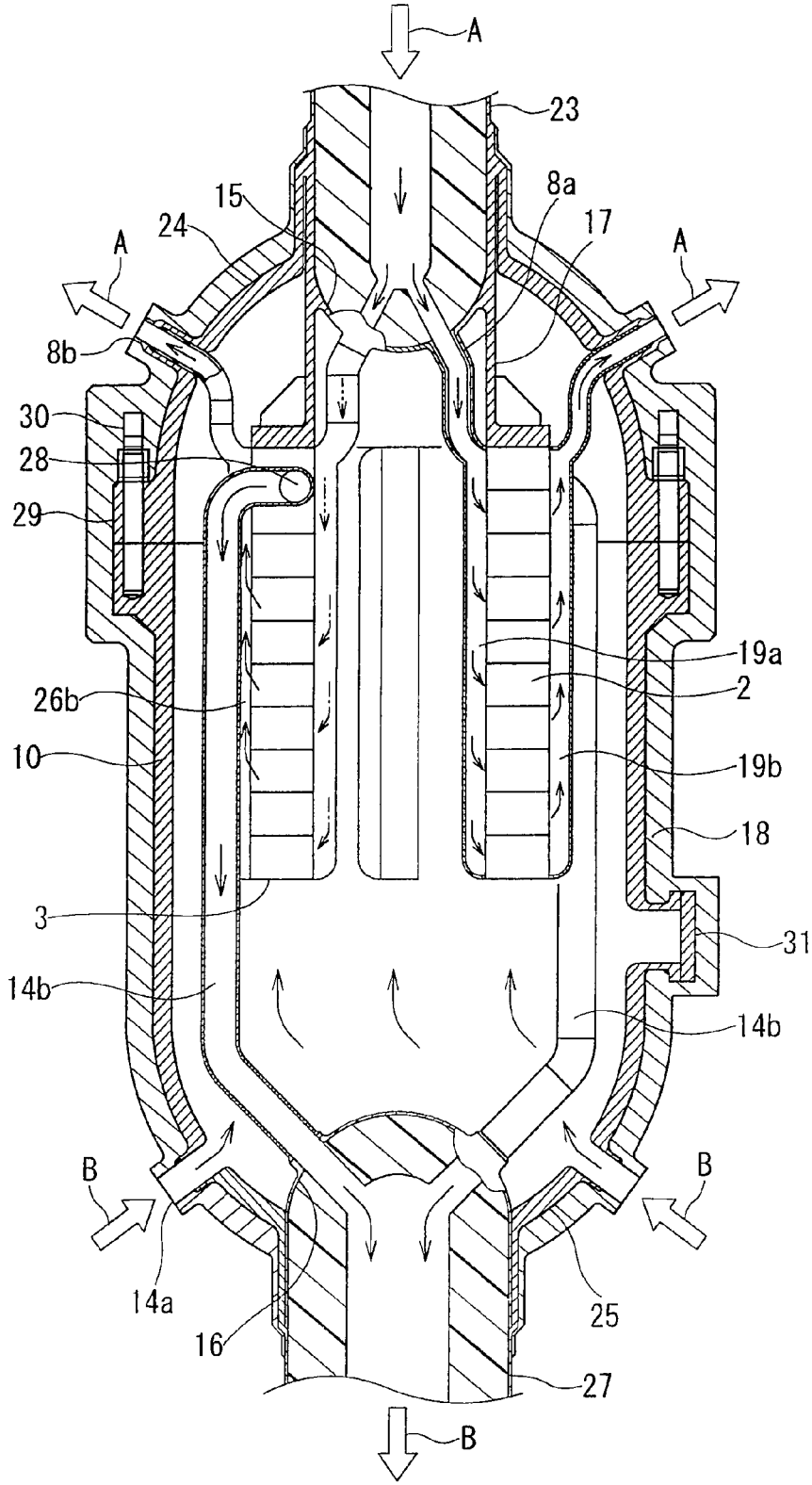
FIG. 10 is a longitudinal sectional view schematically showing a structure of a third embodiment of a heat exchanger according to the present invention.
Figure 11:
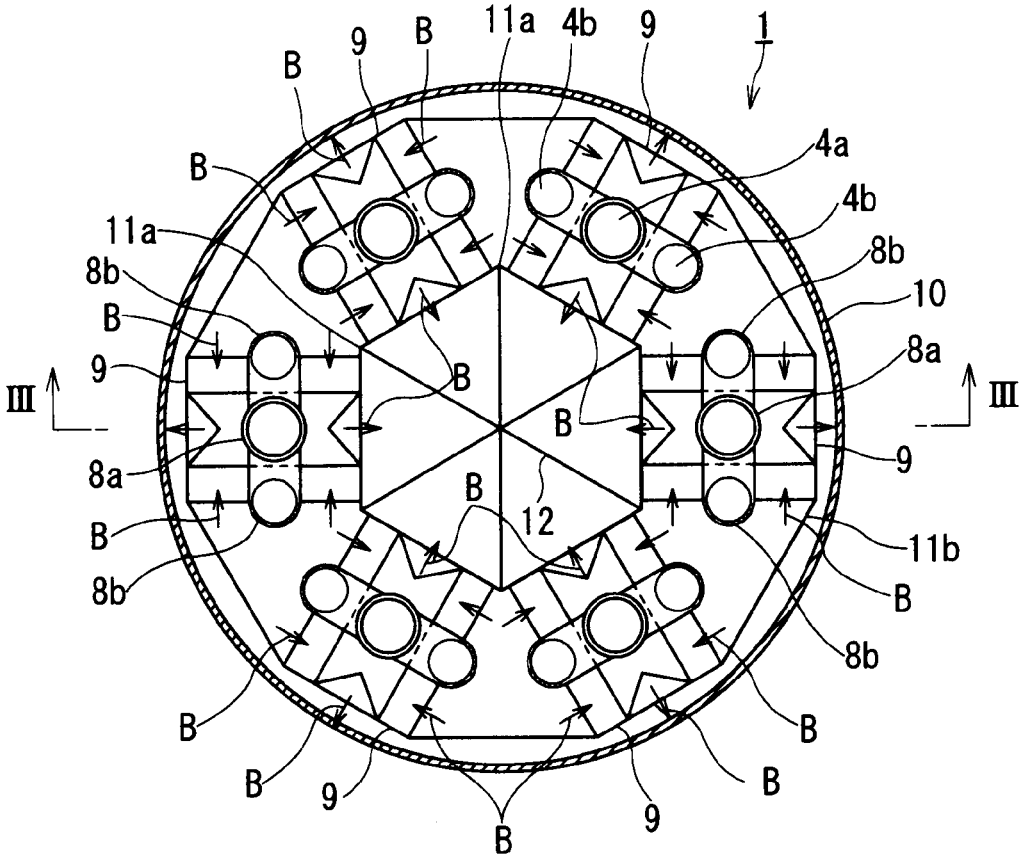
FIG. 11 PRIOR ART
FIG. 11 is a cross sectional view showing the conventional heat exchanger.
Figure 12:
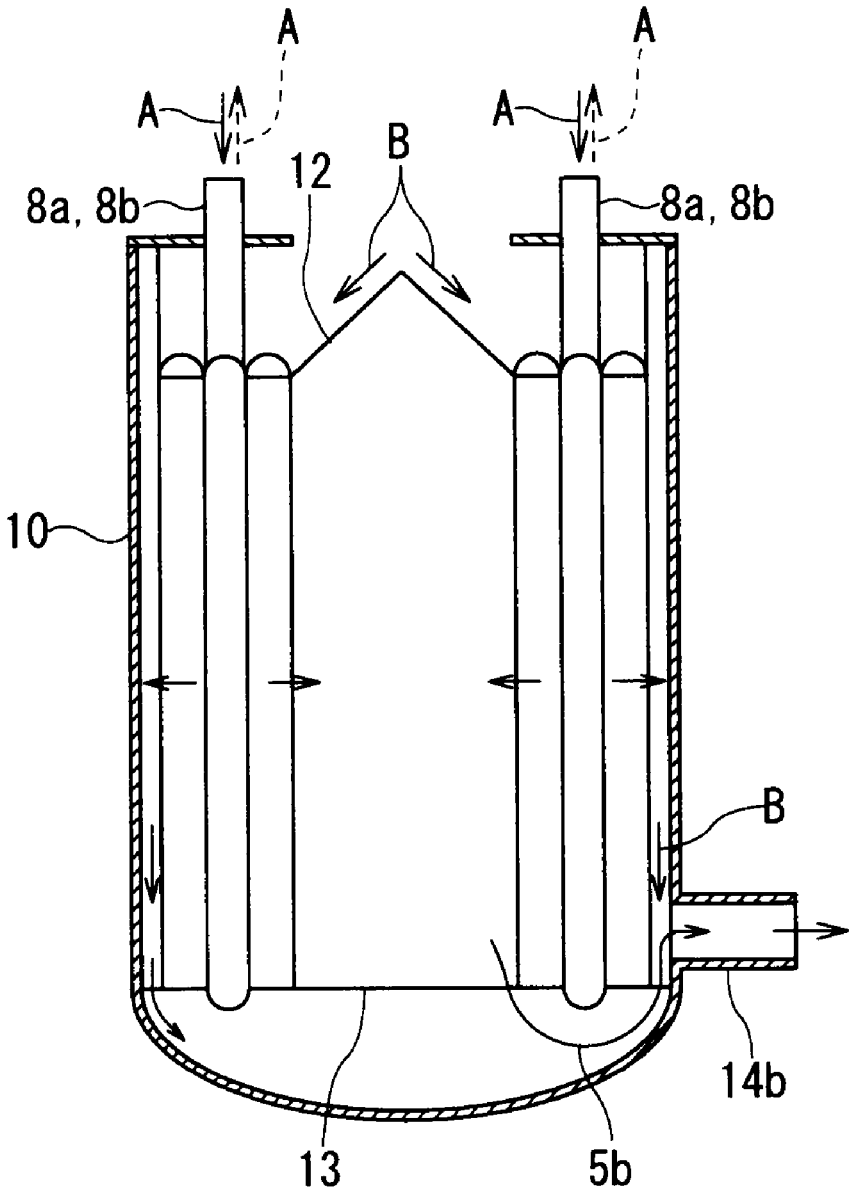
FIG. 12 PRIOR ART
FIG. 12 is a longitudinal sectional view showing the conventional heat exchanger (a sectional view taken along the line III-III of FIG. 11)
Figure 13A:
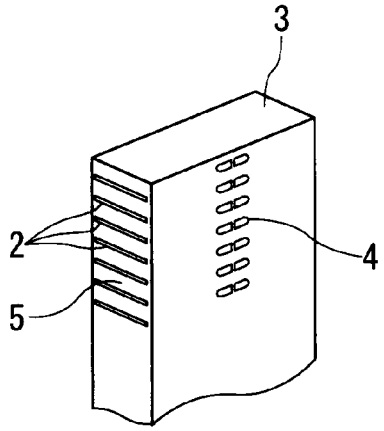
FIG. 13A PRIOR ART
FIGS. 13A-13D are explanatory views showing assembling process of the conventional heat exchanging module.
Figure 13B:
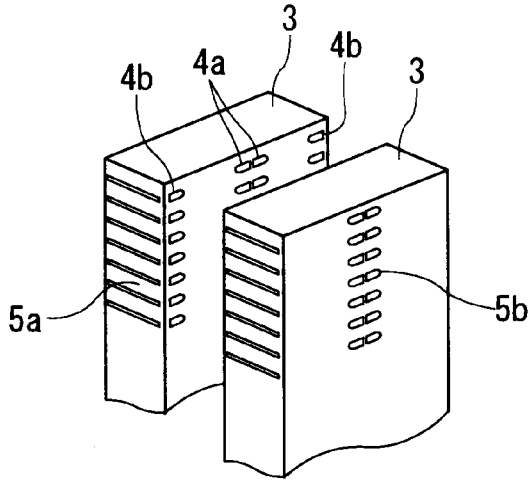
FIG. 13B PRIOR ART
Figure 13C:
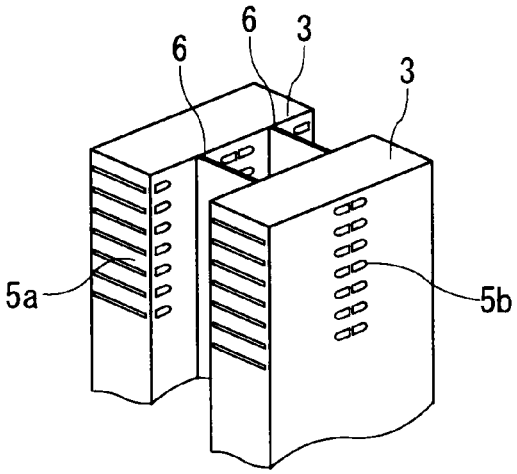
FIG. 13C PRIOR ART
Figure 13D:
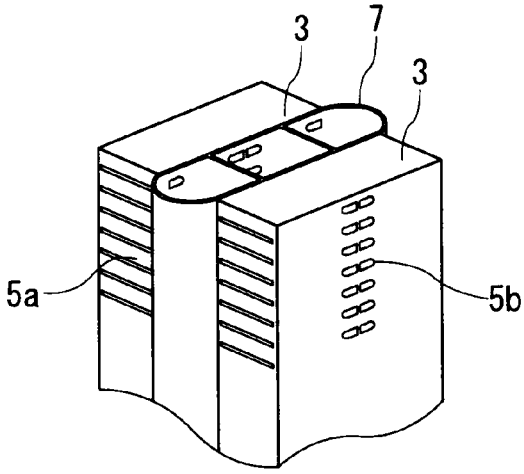
FIG. 13D PRIOR ART
Figure 14C:
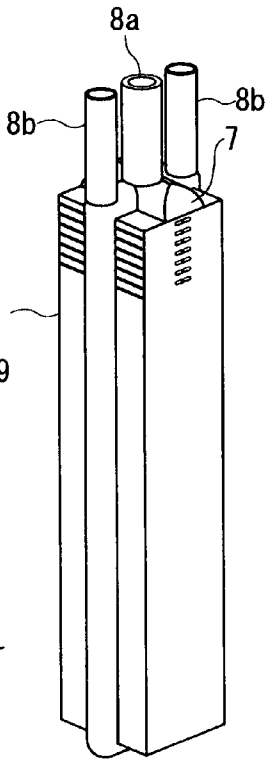
FIG. 14C PRIOR ART
FIGS. 14A-14F are explanatory views each showing the conventional heat exchanging assembly.
Figure 14F:
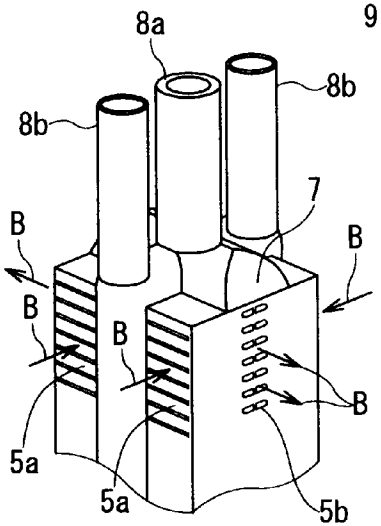
FIG. 14F PRIOR ART
Figure 14B:
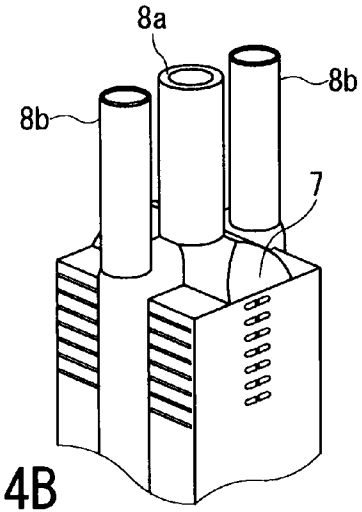
FIG. 14B PRIOR ART
Figure 14E:
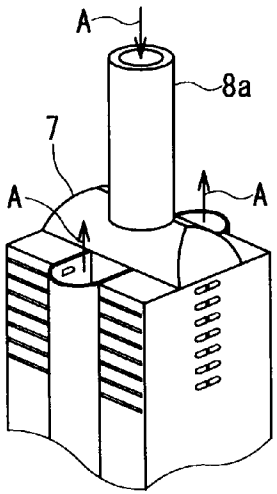
FIG. 14E PRIOR ART
Figure 14A:
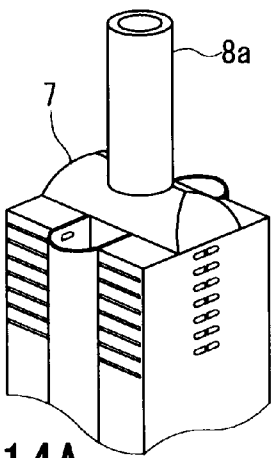
FIG. 14A PRIOR ART
Figure 14D:
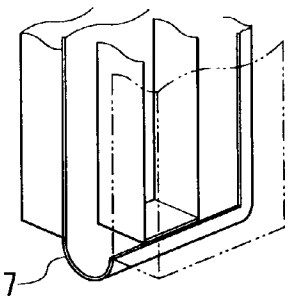
FIG. 14D PRIOR ART

FIG. 10 is a longitudinal sectional view schematically showing a structure of a third embodiment of a heat exchanger according to the present invention. In this third embodiment, the same reference numerals are used in FIG. 10 to denote the same elements or members as those of the first and second embodiments explained in connection with FIG. 1 to FIG. 9, so that the detailed explanations of the same elements or members are omitted hereunder.

As shown in FIG. 10, the heat exchanger 1 of the outstanding third embodiment has a structure in which the heat exchanger 1 per se shown in the first embodiment is arranged so as to be turned upside down.

Due to adoption of this structure, the heat exchanger according to the present third embodiment as applicable to various plant structures without changing functions or performances exhibited in the first and second embodiments In the present third embodiment, as the same manner as in the previous embodiments, there can be also provided a heat exchanger having a small size and pressure withstanding property, and being excellent in maintenance/repairing property and reliability.

As described above, in the heat exchanger of the present invention, a metal plate is subjected to a groove-forming work so as to enable the fluid to flow through the grooves, and a plurality of the metal plates are stacked and integrally connected to thereby constitute a flow path member. The grooves formed at portions between the adjacent two metal plates of the flow path member function as flow paths for flowing the fluid A and the fluid B for heat exchanging, thereby constituting a heat exchanging element. A plurality of the heat exchanging elements are further stacked and integrally connected, and plenums serving as collecting portions for collecting the fluid A or the fluid B are provided to the stacked elements, thus preparing a heat exchanging module.

The heat exchanger includes: a pressure vessel for accommodating the heat exchanging module; a fluid A header connected to the pressure vessel, the fluid A header being formed by blocking the fluid A inlet pipe, followed by attaching the heat insulating material to an inner portion of the fluid A inlet pipe; the fluid A inlet pipe for connecting the fluid A header to the fluid A inlet plenum of the heat exchanging module; the heat insulating material attached to an inner portion of the fluid A inlet pipe; and the fluid A outlet pipe for connecting the fluid A outlet plenum of the heat exchanging module to a cover plate portion of the pressure vessel.

According to the above structure, a temperature of the fluid A inlet pipe can be lowered and a difference in thermal expansion between the fluid A inlet pipe and the fluid A outlet pipe can be also reduced to be small, so that there is no need to attach any expansion joint to the fluid A pipe for the purpose of absorbing the thermal expansion.

Further, the supporting pedestal onto which the heat exchanging module is supported is mounted to the header. In addition, the heat exchanger includes the fluid B outlet plenum of the heat exchanging module and the fluid B outlet pipe for connecting the fluid B outlet plenum to the pressure vessel, wherein an inner portion of the pressure vessel is filled up with the inlet fluid B.

Furthermore, the heat exchanger further includes: the fluid B header connected to the pressure vessel, the fluid B header being formed by blocking the fluid B outlet pipe; a heat insulating material attached to an inner portion of the fluid B header; and the fluid B outlet pipe for connecting the fluid B header to the fluid B outlet plenum, wherein an inner portion of the pressure vessel is filled up with the fluid B inlet fluid. Further, a connecting portion of the fluid B outlet pipe and the fluid B outlet plenum is provided to a portion closest to the fluid A pipe of the heat exchanging module. Further, there are adopted a structure in which the fluid A and the fluid B are reversed.

It is to be further noted that the present invention is not limited to the described embodiments and many other changes and modifications may be made without departing from the scopes of the appended claims.

What is claimed is:

1. A heat exchanger for exchanging heat between a first fluid of high temperature and a second fluid of low temperature, comprising:

a pressure vessel having a air-tight structure and extending in a vertical direction;

an inlet port and an outlet port for the first fluid provided to a lower portion of the pressure vessel;

an inlet port and an outlet port for the second fluid provided to an upper portion of the pressure vessel;

a heat exchanging module disposed in the pressure vessel, the heat exchanging module being formed by stacking a number of heat exchanging elements, in which the inlet port for the first fluid and the outlet port for the second fluid respectively have a header composed of a pipe structural member having a closed bottom portion and a heat insulating material attached to an inner surface of the pipe structural member, and in which the outlet port for the first fluid and the inlet port for the second fluid are located around the respective header; and fluid flowing pipes communicating the bottom portion of the respective header with the heat exchanging module, wherein an outlet plenum of the first fluid and an inlet plenum of the first fluid are connected to the fluid flow pipes at a lower end portion of the heat exchanging module, and the pressure vessel is provided with a supporting pedestal by which the lower end portion of the heat exchanging module is supported.

2. The heat exchanger according to claim 1, wherein the pressure vessel is provided with a manhole.

3. The heat exchanger according to claim 1, wherein a connecting portion between outlet port plenums for the first and second fluids and the fluid flowing pipes is disposed at the lower end portion of the heat exchanging module.

* * * * *